US009856757B2

(12) United States Patent
Strauss

(10) Patent No.: US 9,856,757 B2
(45) Date of Patent: Jan. 2, 2018

(54) CAMSHAFT ADJUSTER

(75) Inventor: Andreas Strauss, Forchheim (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 523 days.

(21) Appl. No.: 14/004,536

(22) PCT Filed: Feb. 23, 2012

(86) PCT No.: PCT/EP2012/053095

§ 371 (c)(1),
(2), (4) Date: Sep. 11, 2013

(87) PCT Pub. No.: WO2012/136408

PCT Pub. Date: Oct. 11, 2012

(65) Prior Publication Data

US 2014/0007827 A1 Jan. 9, 2014

(30) Foreign Application Priority Data

Apr. 4, 2011 (DE) ..... 10 2011 006 691

(51) Int. Cl.

*F01L 1/34* (2006.01)
*F01L 1/344* (2006.01)
*F01L 1/047* (2006.01)

(52) U.S. Cl.

CPC ..... *F01L 1/344* (2013.01); *F01L 1/3442* (2013.01); *F01L 2001/0473* (2013.01); *F01L 2001/34456* (2013.01); *F01L 2001/34466* (2013.01); *F01L 2001/34469* (2013.01); *F01L 2001/34493* (2013.01)

(58) Field of Classification Search

CPC ..... F01L 1/3442; F01L 2001/34489; F01L 1/344; F01L 2001/0473; F01L 2001/34466; F01L 2001/34493
USPC ..... 123/90.15, 90.17
See application file for complete search history.

(56) References Cited

U.S. PATENT DOCUMENTS

| | | | | |
|---|---|---|---|---|
| 2,911,956 | A | 11/1959 | Smith, Jr. | |
| 7,827,945 | B2 * | 11/2010 | Gregor et al. | 123/90.15 |
| 8,051,818 | B2 * | 11/2011 | Myers et al. | 123/90.17 |
| 8,146,551 | B2 * | 4/2012 | Pluta | F01L 1/3442 123/90.15 |
| 8,371,257 | B2 * | 2/2013 | Moon | F01L 1/3442 123/90.15 |
| 2002/0043230 | A1 | 4/2002 | Kinugawa | |
| 2002/0059910 | A1 * | 5/2002 | Methley et al. | 123/90.17 |
| 2005/0226736 | A1 | 10/2005 | Lancefield et al. | |
| 2007/0137598 | A1 * | 6/2007 | Fritz et al. | 123/90.17 |
| 2007/0173297 | A1 * | 7/2007 | Cho et al. | 455/574 |

(Continued)

FOREIGN PATENT DOCUMENTS

| | | | |
|---|---|---|---|
| DE | 102009041755 | A1 | 4/2010 |
| GB | 2369175 | A | 5/2002 |

(Continued)

*Primary Examiner* — Ching Chang
(74) *Attorney, Agent, or Firm* — Davidson, Davidson & Kappel, LLC

(57) ABSTRACT

An arrangement of a camshaft phaser (1) which has a drive element (2) and at least two driven elements (3, 4), whereby the camshaft phaser (1) has a first control valve (7) arranged concentrically to the camshaft phaser (1), and a second control valve (8) arranged off-centered with respect to the rotational axis (5) of the camshaft phaser (1).

14 Claims, 2 Drawing Sheets

(56) References Cited

U.S. PATENT DOCUMENTS

| | | | | |
|---|---|---|---|---|
| 2007/0272183 | A1* | 11/2007 | Schneider | F01L 1/047 123/90.17 |
| 2009/0173297 | A1 | 7/2009 | Hutcheson et al. | |
| 2009/0183702 | A1* | 7/2009 | Knecht | F01L 1/022 123/90.15 |
| 2009/0223470 | A1* | 9/2009 | Rozario et al. | 123/90.17 |
| 2009/0255497 | A1* | 10/2009 | Davis | 123/90.17 |
| 2010/0186698 | A1* | 7/2010 | Pluta | F01L 1/3442 123/90.17 |
| 2011/0220047 | A1* | 9/2011 | Moon | F01L 1/3442 123/90.17 |
| 2012/0279464 | A1* | 11/2012 | Tateno | 123/90.15 |
| 2013/0284132 | A1* | 10/2013 | Watanabe et al. | 123/90.15 |
| 2014/0007831 | A1* | 1/2014 | Heinemann | 123/90.17 |
| 2014/0102392 | A1* | 4/2014 | Busse | 123/90.17 |
| 2014/0190435 | A1* | 7/2014 | Wigsten et al. | 123/90.17 |

FOREIGN PATENT DOCUMENTS

| | | | | |
|---|---|---|---|---|
| GB | 2432645 | A | 5/2007 | |
| GB | 2444943 | A | 6/2008 | |
| WO | WO 0112996 | A1 | 2/2001 | |
| WO | WO 2008157076 | A1 * | 12/2008 | F01L 1/3442 |

* cited by examiner

CAMSHAFT ADJUSTER

The invention relates to a camshaft phaser.

BACKGROUND

Camshaft phasers are used in internal combustion engines in order to vary the timing of the combustion chamber valves. Adapting the timing to the current load lowers fuel consumption and reduces emissions. A commonly employed model is the vane-type adjuster. Vane-type adjusters have a stator, a rotor and a driving gear. The rotor is usually non-rotatably joined to the camshaft. The stator and the driving gear are likewise joined to each other, whereby the rotor is situated coaxially to the stator as well as inside the stator. The rotor and the stator have radial vanes that form oil chambers which counteract each other, which can be filled with oil under pressure and which allow a relative movement between the stator and the rotor. Moreover, the vane-type adjusters have various sealing lids. The assembly comprising the stator, driving gear and sealing lid is secured by means of several screwed connections.

U.S. Pat. Appln. No. 2009/0173297 A1 discloses a hydraulic camshaft phasing device that has a driving gear and, coaxially thereto, a stator with two rotors arranged concentrically to the stator. Here, the stator can be configured so as to consist of a single part or else of several components. The rotors and the stator have radially oriented vanes. In this manner, the stator, together with the rotors, forms working chambers that can be filled with a hydraulic medium under pressure, so that a relative rotation occurs between the appertaining rotor and the stator around the rotational axis of the camshaft phaser. A partition wall that is arranged between the rotors as a component of the stator axially separates the rotors from each other. Each rotor can be connected to a camshaft. In this case, the camshaft is configured as a hollow shaft, whereas the other camshaft is made of solid material. Both camshafts are arranged concentrically with respect to each other. The cams that are associated with the camshafts are connected to their camshaft in such a way that a relative circumferential rotation of the cams or of the appertaining camshafts can occur relative to each other, so that the timing of the inlet and outlet valves associated with the cams can be adjusted continuously and variably.

Such camshaft systems are already known and they comprise an outer hollow shaft with cams that are non-rotatably connected thereto, or for the inlet valves, and comprising an inner shaft with cams likewise non-rotatably connected thereto, or for the outlet valves, whereby these cams are connected to the inner shaft via a pin connection. In order for the outer hollow shaft to be able to rotate around the inner shaft, the pins are inserted into associated slots in the outer hollow shaft. In this manner, the cams of the outer shaft can be rotated with respect to the cams of the inner shaft, and the valve stroke overlap can be regulated, and the opening and closing timing relative to the piston position can be adapted, whereby the piston, in turn, is connected via the crankshaft to a belt and drive that is operationally connected to the driving gear of the camshaft phaser.

SUMMARY OF THE INVENTION

It is an objective of the invention to provide a camshaft phaser that has an especially compact design.

The present invention provides a camshaft phaser with two control valves and yields a camshaft phaser or system whose installation space is optimized and which entails less leakage. The pressure loss that occurs due to long hydraulic paths and leakage is reduced and an improvement of the responsiveness of the camshaft phaser is achieved, at least by the first, centrally and coaxially arranged control valve.

In one embodiment of the invention, the first control valve is associated with the first driven element and it regulates the relative rotation between this first driven element and the drive element, while the second control valve regulates the relative rotation between the second driven element and the drive element. This unambiguous association has the advantage that, as a result of the small distance to the first control valve, the first driven element can be actuated extremely precisely.

In a detailed embodiment of the invention, the first control valve is a central valve arranged in the hub of the camshaft phaser. This reduces the installation space requirements and increases the responsiveness of the camshaft phaser or of the driven element associated with the central valve. A central valve in the hub of the camshaft phaser comprises a control piston that can be moved along the rotational axis of the camshaft phaser and optionally a compression spring that sets the control piston in an initial position. Due to the axial movement of the control piston, openings leading from a feed line of a pressure-medium pump or from a drain of the tank leading to the working chambers can be opened or closed, thus ensuring the feed and drainage of hydraulic medium.

In another embodiment of the invention, the central valve is actuated by a central magnet, as a result of which the control piston is moved coaxially to the rotational axis of the camshaft phaser. The central magnet is arranged so as to be rigidly attached to the housing or to a lid, but also so as to be rotationally uncoupled, that is to say, a rotational movement of the control piston stemming from the camshaft phaser cannot be transmitted to the central magnet. The lid and thus also the central magnet are arranged on the end face, facing away from the camshaft.

Central valves are configured as multi-way valves which have an inlet and an outlet, whereby the inlet or the outlet is connected to the hydraulic-medium channels leading to the working chambers in such a way that the flow of fluid can be permitted or interrupted.

Optionally, the central valve can be arranged inside or coaxially inside the inner camshaft. Advantageously, it is situated at the end of the camshaft to which the camshaft phaser is also attached.

Another embodiment of the invention provides that the second control valve is a cartridge valve. The cartridge valve is arranged on the cylinder head, off-centered with respect to the rotational axis of the camshaft phaser. The freely selectable arrangement of the cartridge valve in terms of its location and positioning creates degrees of freedom in terms of ease of installation, space optimization and functional positioning in the hydraulic system as well as design options for the hydraulic-medium gallery in the cylinder head or in a crankshaft housing.

Cartridge valves, also known as proportional valves, comprise a hydraulic part and a control part permanently connected thereto. The hydraulic part is located in the hydraulic-medium flow of the hydraulic-medium channels and it opens and closes the flow cross-sections in order to distribute the hydraulic medium from the feed line of a pressure-medium pump or from a drain of the tank among the desired hydraulic-medium channels leading to the cartridge valves. Cartridge valves are likewise configured as multi-way valves having several flow cross-sections. The flow cross-sections are usually configured as openings in a sleeve. Inside the sleeve, there is a control piston that likewise has openings and/or ring grooves that open or close the hydraulic-medium paths through the sleeve. The control part of the cartridge valve is configured as a solenoid that, when energized, moves the control piston, so that so that the control piston opens or closes the flow cross-sections. For this purpose, the control piston is moved against the force of a spring that brings the control piston back to its original position when it is in the non-energized state.

The first driven element is supplied by the first control valve. Towards this end, pressure is conveyed by the hydraulic-medium pump to the control valve through a hollow space that is coaxial to the inner camshaft; at the control valve, the pressure is conveyed to the desired working chambers via hydraulic-medium channels of the first driven element.

On the one hand, the hydraulic-medium feed line for the second driven element is implemented by a gallery of several radial hydraulic-medium channels situated parallel to the rotational axis of the camshaft phaser, said channels being arranged in the outer camshaft. On the other hand, the second driven element also has several hydraulic-medium channels having a radial and parallel arrangement by means of which hydraulic medium is conveyed into the appertaining working chambers. The hydraulic-medium channels of the camshaft and of the driven element are opposite from each other so as to be in fluid communication at the connection site between the camshaft and the driven element.

As an alternative, the hydraulic-medium feed can be implemented by creating hydraulic-medium channels in the driven element that lead to the desired working chambers.

Optionally, non-return valves can be installed in the driven elements, in the drive element, in the control valves or in the hydraulic-medium channels.

The inventive arrangement of the control valves with the camshaft phaser for purposes of adjusting two concentric shafts makes it possible to optimally utilize the installation space available, while also improving the responsiveness of the adjuster or of the system.

BRIEF DESCRIPTION OF THE DRAWINGS

Embodiments of the invention are depicted in the figures. The following is shown.

DETAILED DESCRIPTION

Figure 1:
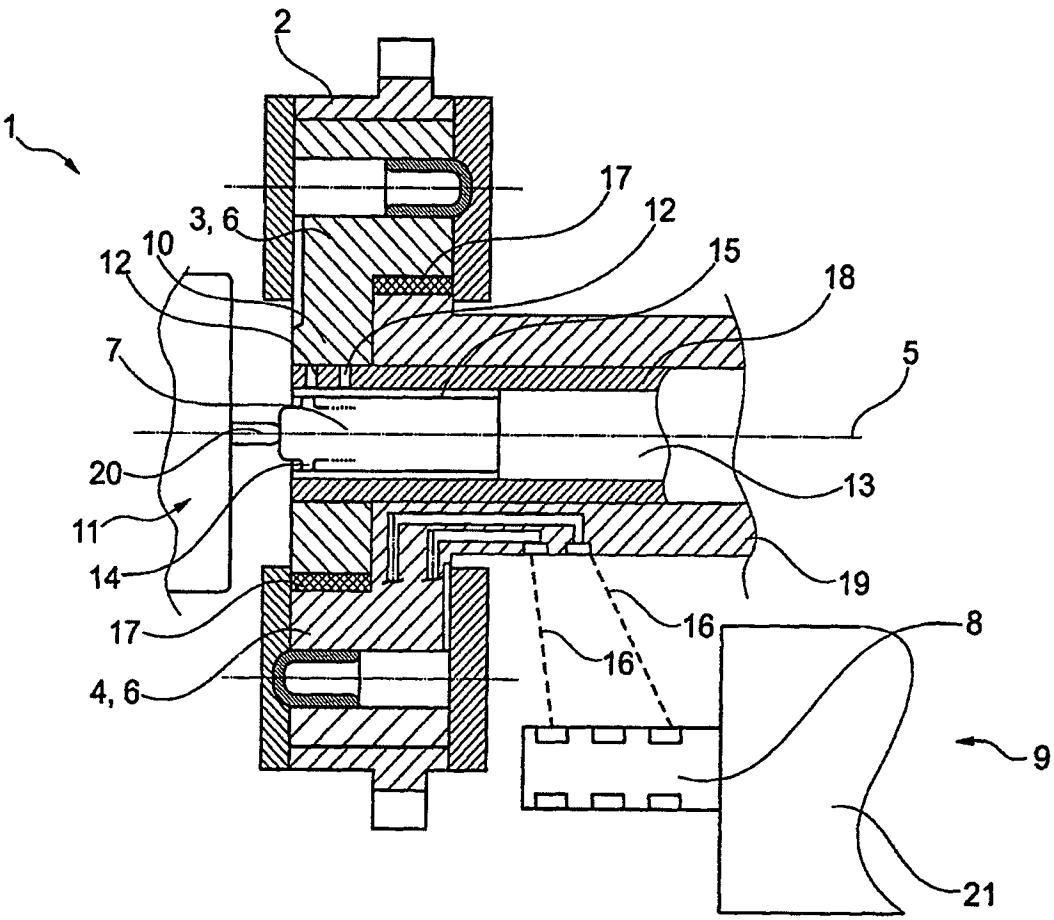
FIG. 1 a camshaft phaser according to the invention, in a longitudinal section along the rotational axis of the camshaft phaser.

FIG. 1 shows a camshaft phaser 1 according to the invention, in a longitudinal section along the rotational axis 5 of the camshaft phaser 1. The camshaft phaser 1 has a drive element 2, a first driven element 3, a second driven element 4, sealing means 17 as well as several radially oriented vanes 6 of the drive element 2 and of the driven elements 3, 4. The hub 10 of the first driven element—which at the same time is the hub of the camshaft phaser 1—is arranged non-rotatably and concentrically on an axial end of a first camshaft 18. The first camshaft 18 has a concentric central channel 13 through which the hydraulic medium can be fed under pressure. The first control valve 7, which comprises a sleeve 15 and a control piston 14, is likewise arranged concentrically in the central channel 13 in the vicinity of the hub 10. The control valve 7 is arranged axially rigidly with respect to the first camshaft. The control piston 14 is arranged axially movably with respect to the sleeve 15 and it can be spring-loaded in an axial direction with respect to the sleeve 15 in order to remain in a resting position when it is in its non-actuated state. The control piston 14 is actuated by means of a central magnet 11 that is arranged on an end face on the side of the camshaft phaser 1 facing away from the camshaft. The central magnet 11 actuates the control piston 14 in the axial direction by means of an actuating pin 20, thus moving the control piston 14 relative to the sleeve 15. The sleeve 15 and the control piston 14 are each provided with openings known from the state of the art, said openings then being opened or closed during an axial relative movement. The hydraulic medium is fed through the central channel 13 along the rotational axis 5 into the first control valve 7. Depending on the position of the control piston 14 relative to the sleeve 15, this hydraulic medium is distributed among the corresponding hydraulic-medium channels 12 and thus radially through the hub 10, said channels each opening up into corresponding working chambers A, B.

The working chambers C, D are supplied by means of a second control valve 8 that is configured here as a cartridge valve 9. This second control valve 8 is not arranged concentrically to the rotational axis 5, but rather, it can be attached as desired to a receptacle in the engine. Via hydraulic-medium channels 16, the hydraulic medium reaches the working chambers C, D of the second driven element 4. The cartridge valve 9 comprises a hydraulic part that is in communication with hydraulic-medium channels and that, like the first control valve 7, can distribute hydraulic medium from a pressure pump among the appertaining hydraulic-medium channels. The actuation is carried out by means of a solenoid 21. The hydraulic part of the cartridge valve 9 is likewise equipped with a control piston whose mode of operation is familiar to the person skilled in the art, so that it will not be elaborated upon here.

The arrangement according to the invention makes it clear that, in order to independently actuate the first driven element 3 and the second driven element 4, it is advantageous to arrange two separate control valves in the installation space, so that direct hydraulic-medium channels can be employed. The two control valves can be supplied with hydraulic medium from the pressure pump either via a single feed line or else separately from each other, and even employing two different pressure pumps.

Figure 2:
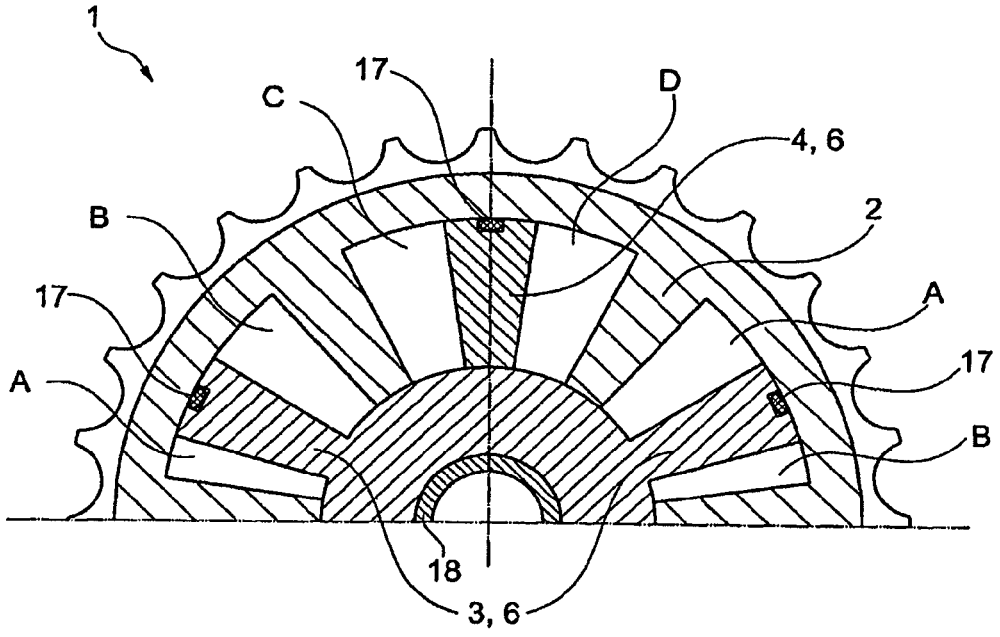
FIG. 2 a camshaft phaser according to the invention, in a cross-sectional view along the rotational axis of the camshaft phaser.

FIG. 2 shows a camshaft phaser 1 according to the invention, in a cross-section perpendicular to the rotational axis 5 of the camshaft phaser 1. This depiction clearly shows the formation of the working chambers A, B, D, C by the driven elements 3 and 4 with the drive element 2. Together with a vane pair of the drive element 2, each vane 6 of a driven element 3 or 4 forms two working chambers A and B. Thus, together with the vanes 6 of the drive element 2, the vane 6 of the driven element 3 defines the working chambers A and B. In contrast, in a comparable manner, the driven element 4, together with the drive element 2, forms the working chambers C and D. The radial, outer ends of the vanes 6 of the driven elements 3 and 4 have sealing means 17 that separate the working chambers in an oil-tight manner. Moreover, at least between a driven element 3 or 4 and the drive element 2, the camshaft phaser 1 has a spring element 13 in the circumferential direction 12. Here, both driven elements 3 and 4 are tensioned with the drive element 2 by means of a spring element 13.

Therefore, when the working chamber A or B is filled with hydraulic medium, the driven element 3 can be rotated relative to the drive element 2. Filling the working chambers C and D with hydraulic medium causes a relative rotation between the driven element 4 and the drive element 2.

LIST OF REFERENCE NUMERALS

1 camshaft phaser
2 drive element
3 first driven element
4 second driven element
5 rotational axis
6 vanes
7 first control valve
8 second control valve
9 cartridge valve
10 hub
11 central magnet
12 hydraulic-medium channel
13 central channel
14 control piston
15 sleeve
16 hydraulic-medium channel
17 sealing means
18 first camshaft
19 second camshaft
20 actuating pin
21 solenoid
A working chamber
B working chamber
C working chamber
D working chamber

What is claimed is:

1. A camshaft phaser comprising:
a single drive element rotating at a first speed;
a first driven element;
a second driven element, the first driven element and second driven element each being driven by the single drive element,
each of the single drive, first driven and second driven elements arranged coaxially to a rotational axis of the camshaft phaser;
the first and second driven elements and the single drive element having several radially oriented vanes, the several radially oriented vanes forming several working chambers fillable with a hydraulic medium under pressure so that a relative rotation is possible between the single drive element and one of the first and second driven elements as well as between the first and second driven elements themselves;
a first control valve arranged coaxially to the rotational axis; and
a second control valve arranged off-centered with respect to the rotational axis, the first and second control valves for regulating pressurization of the several working chambers.

2. The camshaft phaser as recited in claim 1 wherein the first control valve regulates a first relative rotation between the drive element and the first driven element, while the second control valve regulates a second relative rotation between the drive element and the second driven element.

3. The camshaft phaser as recited in claim 1 wherein the first control valve is a central valve and is arranged in a hub of the camshaft phaser.

4. The camshaft phaser as recited in claim 3 further comprising a central magnet for actuating the central valve.

5. The camshaft phaser as recited in claim 1 wherein the second control valve is a cartridge valve.

6. The camshaft phaser as recited in claim 1 wherein the first driven element is connectable to a first camshaft, while the second driven element is connectable to a second camshaft.

7. A camshaft system comprising a first camshaft, a second camshaft and the camshaft phaser as recited in claim 1, the first driven element connectable to the first camshaft, the second driven element connectable to the second camshaft, and when the working chambers are filled with a hydraulic medium under pressure, a relative rotation occurs of both the first and second driven elements with respect to each other and thus also of the first and second camshafts with respect to each other, as well as another relative rotation of the first and second driven elements with respect to the drive element.

8. A camshaft phaser comprising:
a drive element;
a first driven element;
a second driven element,
each of the drive, first driven and second driven elements arranged coaxially to a rotational axis of the camshaft phaser;
the first and second driven elements and the drive element having several radially oriented vanes, the several radially oriented vanes of each of the first and second driven elements and the drive element overlapping axially and forming several working chambers fillable with a hydraulic medium under pressure so that a relative rotation is possible between the drive element and one of the first and second driven elements as well as between the first and second driven elements themselves;
a first control valve arranged coaxially to the rotational axis; and
a second control valve arranged off-centered with respect to the rotational axis, the first and second control valves for regulating pressurization of the several working chambers.

9. The camshaft phaser as recited in claim 8 wherein the first control valve regulates a first relative rotation between the drive element and the first driven element, while the second control valve regulates a second relative rotation between the drive element and the second driven element.

10. The camshaft phaser as recited in claim 8 wherein the first control valve is a central valve and is arranged in a hub of the camshaft phaser.

11. The camshaft phaser as recited in claim 10 further comprising a central magnet for actuating the central valve.

12. The camshaft phaser as recited in claim 8 wherein the second control valve is a cartridge valve.

13. The camshaft phaser as recited in claim 8 wherein the first driven element is connectable to a first camshaft, while the second driven element is connectable to a second camshaft.

14. A camshaft system comprising a first camshaft, a second camshaft and the camshaft phaser as recited in claim 8, the first driven element connectable to the first camshaft, the second driven element connectable to the second camshaft, and when the working chambers are filled with a hydraulic medium under pressure, a relative rotation occurs of both the first and second driven elements with respect to each other and thus also of the first and second camshafts with respect to each other, as well as another relative rotation of the first and second driven elements with respect to the drive element.

* * * * *